US007319446B2

(12) United States Patent
Oh et al.

(10) Patent No.: US 7,319,446 B2
(45) Date of Patent: Jan. 15, 2008

(54) ORGANIC ELECTROLUMINESCENT DISPLAY DEVICE AND DRIVING METHOD THEREOF

(75) Inventors: Du-Hwan Oh, Chungcheongbukdo (KR); Hoon-Ju Chung, Gyeonggido (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 11/108,767

(22) Filed: Apr. 19, 2005

(65) Prior Publication Data

US 2006/0232217 A1 Oct. 19, 2006

(51) Int. Cl.
*G09G 3/30* (2006.01)
*G09G 3/32* (2006.01)

(52) U.S. Cl. ..... 345/76; 315/169.3; 315/291; 345/76; 345/82; 345/204

(58) Field of Classification Search ..... 315/169.3, 315/291; 345/76, 82, 92, 204
See application file for complete search history.

(56) References Cited

U.S. PATENT DOCUMENTS 6,873,313 B2 * 3/2005 Washio et al. ..... 345/100
6,989,826 B2 * 1/2006 Kasai ..... 345/204
2005/0116917 A1 * 6/2005 Aoki ..... 345/99
2005/0184935 A1 * 8/2005 Lee et al. ..... 345/76
2005/0206635 A1 * 9/2005 Hashimoto ..... 345/204
2005/0219166 A1 * 10/2005 Kim ..... 345/76
2005/0264495 A1 * 12/2005 Shin ..... 345/76
2005/0270205 A1 * 12/2005 Jo et al. ..... 341/144
2005/0270257 A1 * 12/2005 Shin ..... 345/76

* cited by examiner

*Primary Examiner*—Trinh Vo Dinh
(74) *Attorney, Agent, or Firm*—McKenna, Long & Aldridge LLP

(57) ABSTRACT

An organic electroluminescent display device includes a gate line receiving a gate signal, a data line crossing the gate line, the data line receiving a data signal, a switching thin film transistor switching the data signal according to the gate signal, a driving thin film transistor connected to the switching thin film transistor and receiving the data signal, a power line supplying a current to the driving thin film transistor, an organic electroluminescent diode connected to the driving thin film transistor, and a pre-charge element inputting a pre-charge voltage to the data line before the data line receives the data signal.

12 Claims, 7 Drawing Sheets

ORGANIC ELECTROLUMINESCENT DISPLAY DEVICE AND DRIVING METHOD THEREOF

BACKGROUND OF THE INVENTION

1. Field of the Invention

The present invention relates to an organic electroluminescent display device, and more particularly, to an organic electroluminescent display device having a pre-charge circuit and a driving method thereof.

2. Discussion of the Related Art

Among flat panel displays (FPDs), organic electroluminescent (EL) devices have been of particular interest in research and development because they are self-light-emitting type displays having a wide viewing angle as well as a high contrast ratio in comparison to liquid crystal display (LCD) devices. Organic EL devices are lightweight and small, as compared to other types of display devices, because they do not need a backlight. Organic EL devices have other desirable characteristics, such as low power consumption, superior brightness and fast response time. When driving the organic EL devices, only a low direct current (DC) voltage is required. Moreover, a fast response time can be obtained.

Unlike LCD devices, organic EL devices are entirely formed in a solid phase arrangement. Thus, organic EL devices are sufficiently strong to withstand external impacts and also have a greater operational temperature range. Moreover, organic EL devices are fabricated in a relatively simple process involving few processing steps. Thus, it is much cheaper to produce an organic EL device in comparison to an LCD device or a plasma display panel (PDP). For example, only deposition and encapsulation processes are necessary for manufacturing organic EL devices. An organic EL device is often referred to as an organic light emitting diode (OLED).

There are two types of organic EL display devices: passive matrix type and active matrix type. While both the passive matrix organic EL display device and the active matrix organic EL display device have simple structures and are formed by a simple fabricating process, the passive matrix organic EL display device requires a relatively high amount of power to operate. In addition, the display size of a passive matrix organic EL display device is limited by its structure. Furthermore, as the number of conductive lines increases, the aperture ratio of a passive matrix organic EL display device decreases.

In contrast, active matrix organic EL display devices are highly efficient and can produce a high-quality image for a large display size with a relatively low power. In general, in an active matrix type organic EL device, a voltage controlling a current applied to a pixel is stored in a storage capacitor. Accordingly, the voltage in the storage capacitor can be applied to the pixel until a next frame and the pixel can continuously display an image during one frame. As a result, an active matrix type organic EL device has a low power consumption, a high resolution and a large display size because it can display images with a constant brightness in spite of a low driving current.

FIG. 1 is a circuit diagram showing an organic electroluminescent display device according to the related art. In FIG. 1, a gate line is disposed along a first direction and a data line is disposed a second direction crossing the gate line. A pixel region is defined by the gate line and the data line. A power line spaced apart from the data line is disposed along the second direction. A switching thin film transistor (TFT) "$T_S$" as an addressing element is connected to the gate line and the data line. A storage capacitor "$C_{ST}$" is connected to the switching TFT "$T_S$." A driving TFT "$T_D$" as a current source element is connected to the switching TFT "$T_S$," the storage capacitor "$C_{ST}$" and the power line. An organic electroluminescent (EL) diode "$D_{EL}$" including first and second electrodes is connected to the driving TFT "$T_D$." The switching TFT "$T_S$" controls a gate voltage of the driving TFT "$T_D$" and the storage capacitor "$C_{ST}$" stores the gate voltage of the driving TFT "$T_D$."

During a non-selected time period, a gate scanning pulse is applied to a gate electrode of the switching TFT "$T_S$," the switching TFT "$T_S$" is turned on and a data signal is transferred to the driving TFT "$T_D$" and the storage capacitor "$C_{ST}$" through the switching TFT "$T_S$." In addition, the driving TFT "$T_D$" is turned on and a current is supplied to the organic EL diode "$D_{EL}$" through the driving TFT "$T_D$" by the power line. As a result, an organic luminescent layer of the organic EL diode "$D_{EL}$" emits light. Since a turn-on ratio of the driving TFT "$T_D$" depends on a magnitude of the data signal, the current passing through the driving TFT "$T_D$" can be adjusted by the data signal to display various degree of gray. Furthermore, during a non-selected time period where the gate scanning pulse is not applied to the switching TFT "$T_S$," the data signal stored in the storage capacitor "$C_{ST}$" is continuously applied to the driving TFT "$T_D$." Accordingly, the organic EL diode "$D_{EL}$" continuously emits light until a gate signal of a next frame is applied to the switching TFT "$T_S$."

FIG. 2 is a timing chart showing a plurality of driving signals for a four-block driving method of an organic electroluminescent display device according to the related art. As shown in FIG. 2, the four-block driving method uses $N^{th}$ and $(N+1)^{th}$ gate clocks "GCLKN" and "GCLKN+1," a data start signal "DVST," first to fourth data clocks "DCLK1" to "DCLK4" and a data signal "VIDEO." Gate scanning pulses are sequentially applied to an $N^{th}$ gate line and an $(N+1)^{th}$ gate line according to the respective gate clock, "GCLKN" and "GCLKN+1," and switching TFTs connected to the $N^{th}$ gate line and the $(N+1)^{th}$ gate line are sequentially turned on. When the $N^{th}$ gate line is selected, the first to third data clocks "DCLK1" to "DCLK3" are sequentially generated. Accordingly, the data signal "VIDEO" supplied to a corresponding data line is transferred to a gate electrode of a corresponding driving TFT through the corresponding switching TFT. Since the data signal "VIDEO" controls the driving TFT, transfer accuracy of the data signal "VIDEO" to an organic EL diode depends on characteristics of the driving TFT.

FIG. 3 is a graph showing characteristics of a driving thin film transistor for an organic electroluminescent display device according to the related art. In FIG. 3, the x-axis and the y-axis respectively represent a gate-source voltage "$V_{gs}$" between a gate electrode and a source electrode and a drain-source current "$I_{ds}$" flowing between a drain electrode and a source electrode. As shown in the I-V curve, in a section of a first voltage value "$V_1$" to a third voltage value "$V_3$," the drain-source current "$I_{ds}$" increases as the gate-source voltage "$V_{gs}$" increases. Accordingly, the drain-source current "$I_{ds}$" input to an organic electroluminescent (EL) diode from a power line is adjusted by controlling the gate-source voltage "$V_{gs}$," thereby controlling the organic EL diode to display images of various grays.

However, when the driving TFT has a hysteresis, the driving TFT fails to normally transfer a data signal to the organic EL diode. A first curve 10 is obtained when the drain-source current "$I_{ds}$" is measured along an increasing "SWEEP1" of the gate-source voltage "$V_{gs}$," while a second curve 20 different from the first curve 10 is obtained when the drain-source current "$I_{ds}$" is measured along a decreasing "SWEEP2" of the gate-source voltage "$V_{gs}$." Both of the first and second curves 10 and 20 have a first current value "$I_A$" at the third voltage value "$V_3$" corresponding to a white image, and have a fourth current value "$I_D$" at the first voltage value "$V_1$" corresponding to a black image. Accordingly, the white image and the black image may be displayed without difference along the increasing "SWEEP1" of the gate-source voltage "$V_{gs}$" and along the decreasing "SWEEP2" of the gate-source voltage "$V_{gs}$."

For the second voltage value "$V_2$" corresponding to a gray image, however, a second current value "$I_B$" measured along the increasing "SWEEP1" of the gate-source voltage "$V_{gs}$" is higher than a third current value "$I_C$" measured along the decreasing "SWEEP2" of the gate-source voltage "$V_{gs}$." Accordingly, when the second voltage value "$V_2$" is applied to the gate electrode of the driving TFT, the drain-source current "$I_{ds}$" of the driving TFT is differently determined according to a gate voltage of the previous frame. Further, such a difference in the drain-source current "$I_{ds}$" causes a difference in brightness of the organic EL diode.

FIGS. 4A and 4B are schematic views showing images produced by an organic electroluminescent display device according to the related art. As shown in FIG. 4, an organic electroluminescent display device may produce a chess-board image having white and black images. In particular, the chess-board image includes a white region "A" and a black region "D." Thus, this chess-board image is produced by applying the third voltage "$V_3$" (as shown in FIG. 3) to the gate electrode of the driving TFT in the white region "A" and by applying the first voltage "$V_1$" (as shown in FIG. 3) to the gate electrode of the driving TFT in the black region "D."

Ideally, the organic electroluminescent display device should produce gray images of an equal brightness throughout all display areas when a same level of driving voltage is applied thereto, even immediately after the chess-board pattern is displayed. However, when the driving TFT has a hysteresis as shown in FIG. 3, a current value of the driving TFT in the white region "A" is different from a current value of the driving TFT in the black region "D." For example, as shown in FIG. 4B, when the organic electroluminescent display device is driven to display a gray image over its entire display area immediately after a chess-board image is displayed, a resultant image includes a first gray region "B" and a second gray region "C" respectively corresponding to the white region "A" and the black region "D." In particular, a brightness of the first gray region "B" is lower than a brightness of the second gray region "C."

That is, although the same second voltage V2 is applied to the gates electrodes of the driving TFTs in the first and second gray regions "B" and "C," the driving TFT in the first gray region "B" has the third current value "$I_C$" and the driving TFT in the second gray region "C" has the second current value "$I_B$." In particular, the second current value "$I_B$" is higher than third current value "$I_C$" because the driving TFT has a hysteresis as shown in FIG. 3. Accordingly, the hysteresis of the driving TFT causes an abnormal display such as a gray chess image and an residual image as shown in FIG. 4B.

SUMMARY OF THE INVENTION

Accordingly, the present invention is directed to an organic electroluminescent display device and a driving method thereof that substantially obviate one or more of the problems due to limitations and disadvantages of the related art.

An object of the present invention is to provide an organic electroluminescent display device where an abnormal display such as a residual image is prevented, and a driving method thereof.

Another object of the present invention is to provide an organic electroluminescent display device where a signal corresponding to a black image is input before a data signal is applied, and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the organic electroluminescent display device includes a gate line receiving a gate signal, a data line crossing the gate line, the data line receiving a data signal, a switching thin film transistor switching the data signal according to the gate signal, a driving thin film transistor connected to the switching thin film transistor and receiving the data signal, a power line supplying a current to the driving thin film transistor, an organic electroluminescent diode connected to the driving thin film transistor, and a pre-charge element inputting a pre-charge voltage to the data line before the data line receives the data signal.

In another aspect, the method of driving an organic electroluminescent display device includes inputting a gate signal to a gate line, inputting a data signal to a data line, and inputting a pre-charge voltage to the data line before inputting the data signal to the data line.

It is to be understood that both the foregoing general description and the following detailed description are exemplary and explanatory and are intended to provide further explanation of the invention as claimed. dr

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
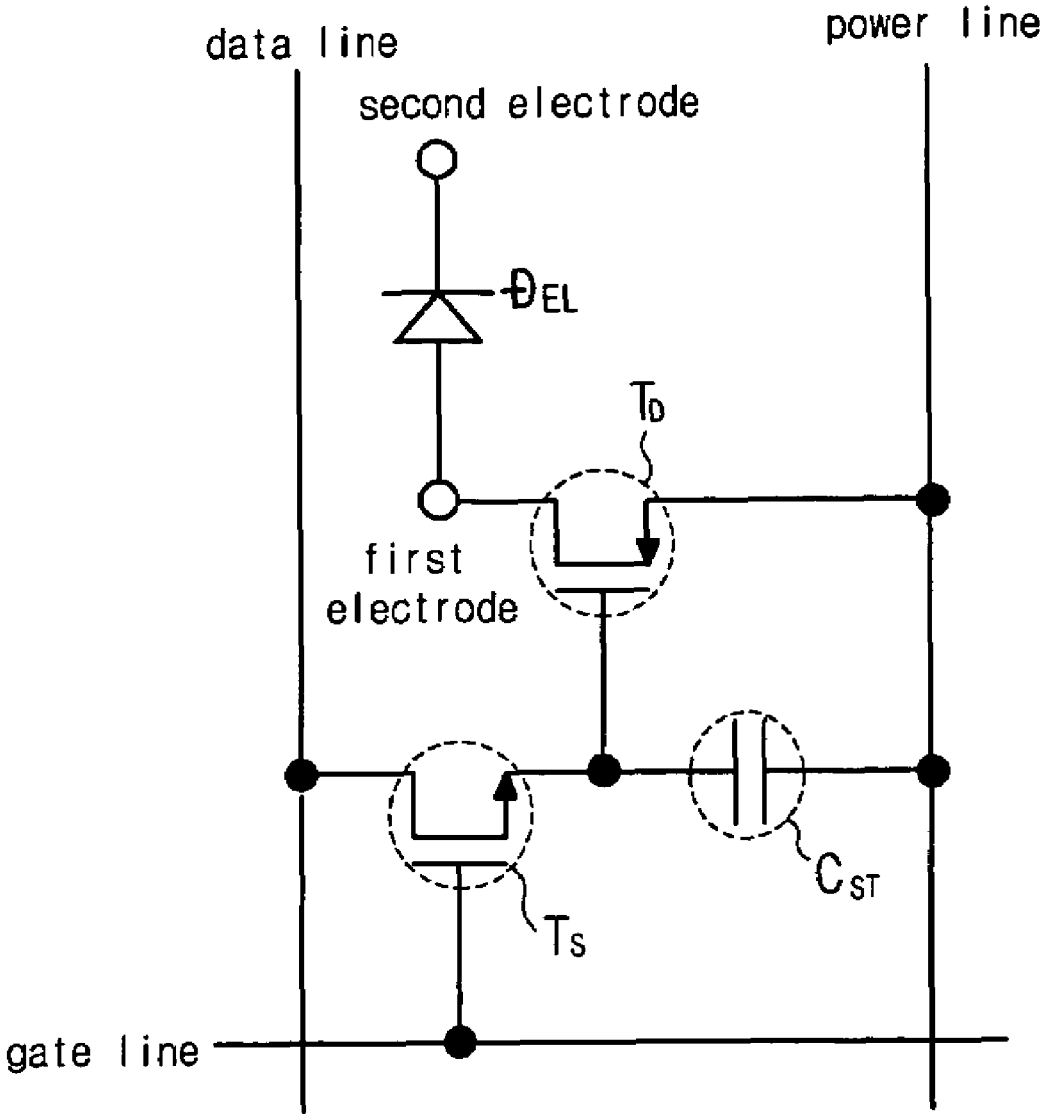
FIG. 1 Related Art
FIG. 1 is a circuit diagram showing an organic electroluminescent display device according to the related art.
Figure 2:
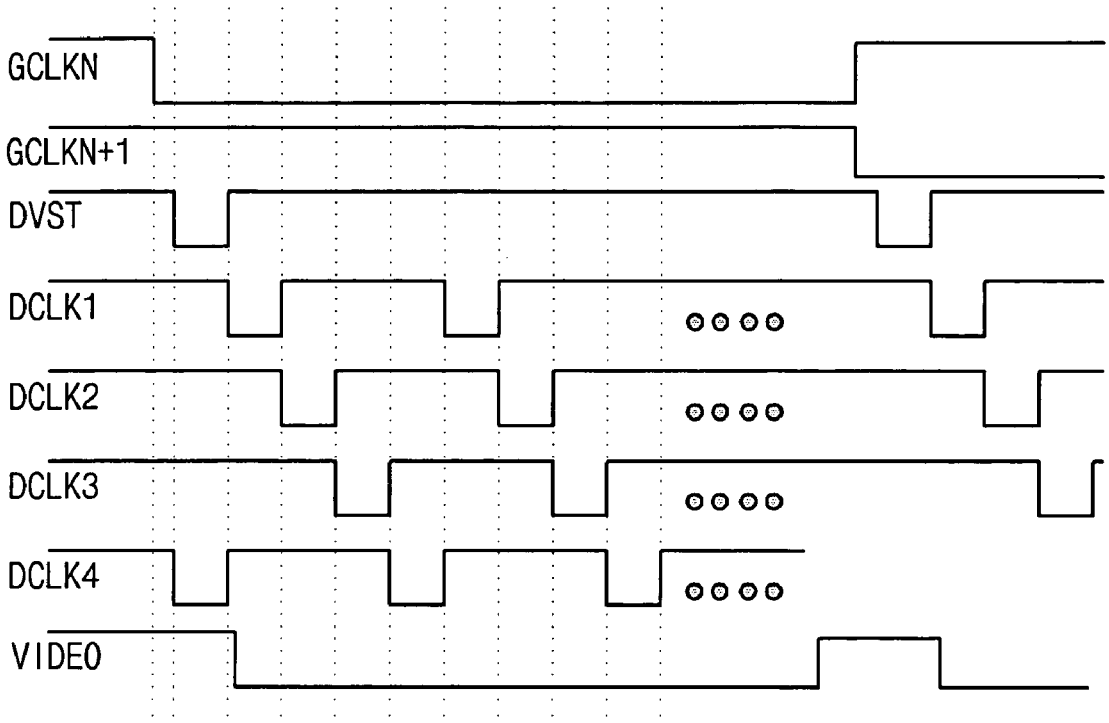
FIG. 2 Related Art
FIG. 2 is a timing chart showing a plurality of driving signals for a four-block driving method of an organic electroluminescent display device according to the related art.
Figure 3:
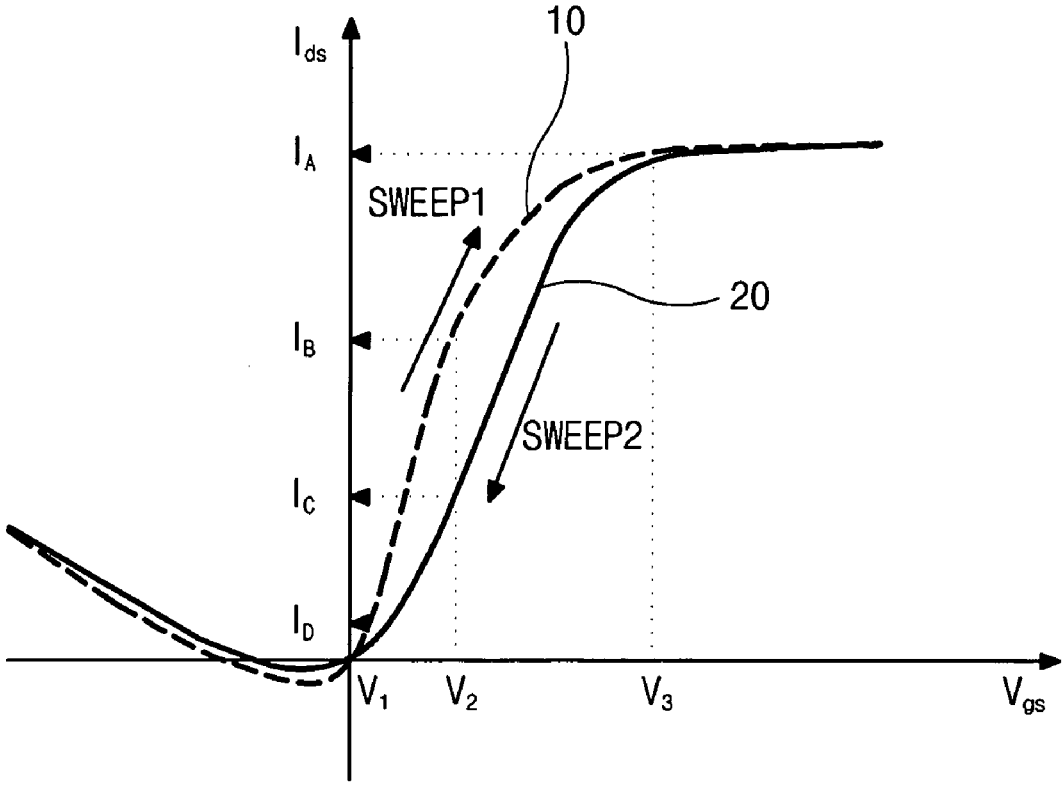
FIG. 3 Related Art
FIG. 3 is a graph showing characteristics of a driving thin film transistor for an organic electroluminescent display device according to the related art.
Figure 4A:
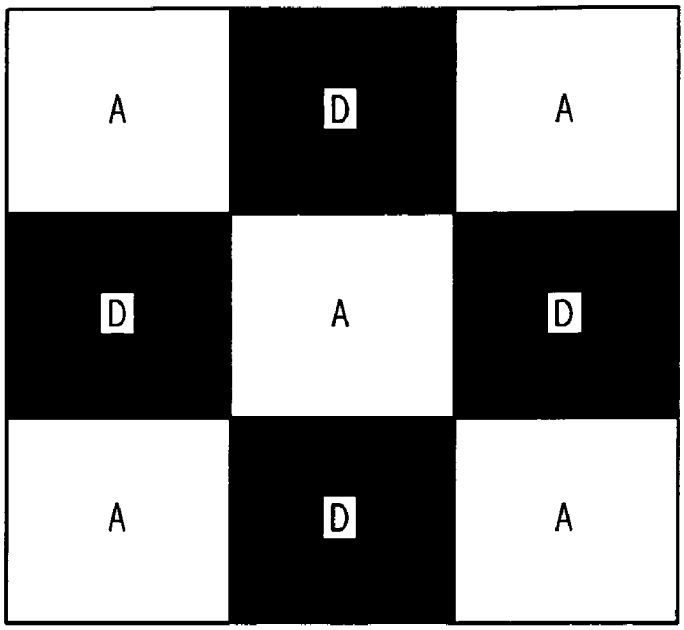
FIG. 4A Related Art
FIGS. 4A and 4B are schematic views showing images produced by an organic electroluminescent display device according to the related art.
Figure 4B:
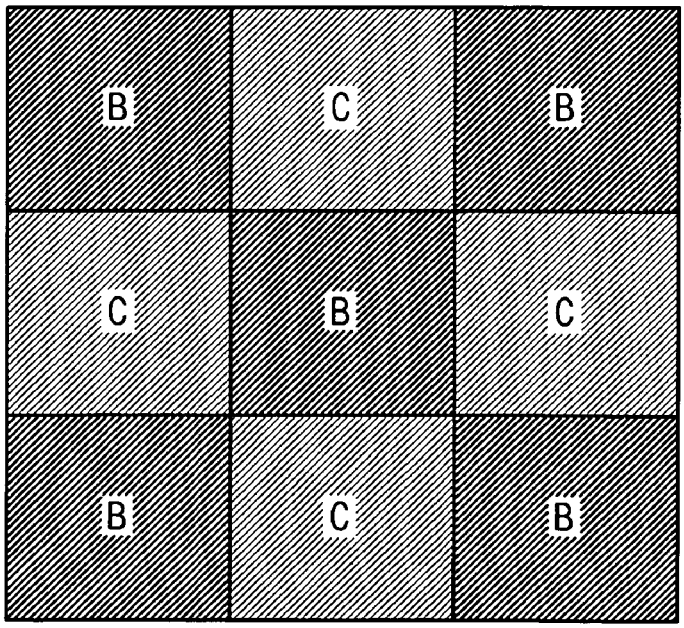
FIG. 4B Related Art
Figure 5:
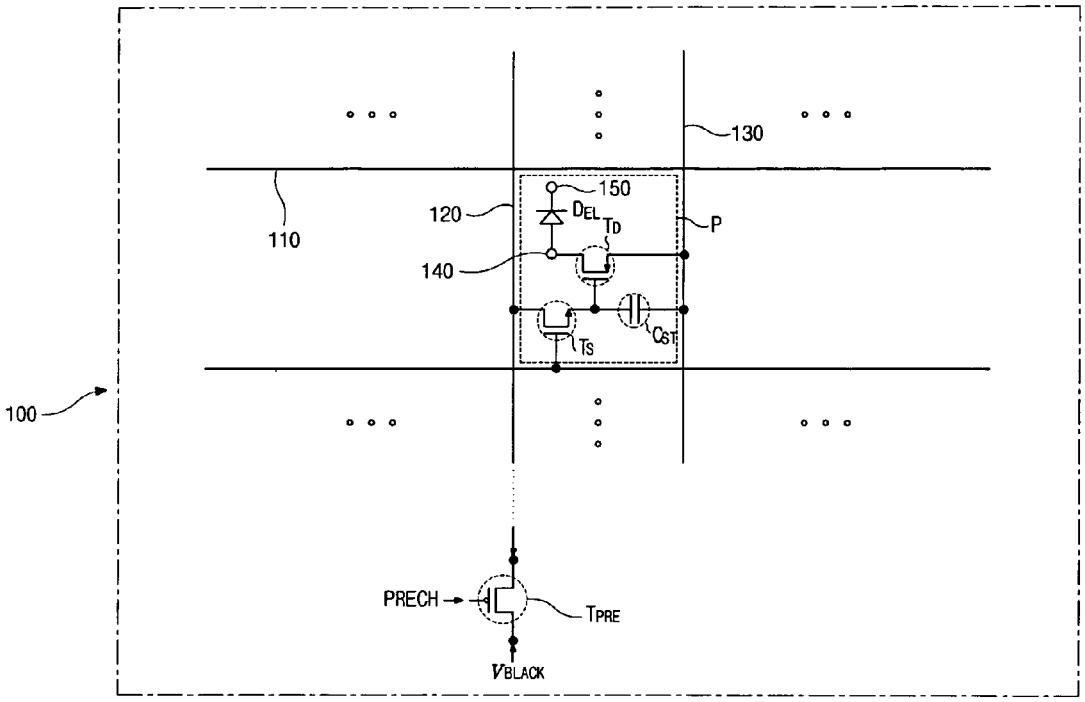
FIG. 5 is a schematic circuit diagram showing an organic electroluminescent display device according to an embodiment of the present invention.

FIG. 5 is a schematic circuit diagram showing an organic electroluminescent display device according to an embodiment of the present invention. In FIG. 5, an organic electroluminescent display (ELD) device 100 includes a gate line 110, a data line 120 and a power line 130. The data line 120 and the power line 130 cross the gate line 110 to define a pixel region "P." A switching thin film transistor (TFT) "$T_S$" as an addressing element is connected to the gate line 110 and the data line 120. A storage capacitor "$C_{ST}$" is connected to the switching TFT "$T_S$," and a driving TFT "$T_D$" as a current source element is connected to the switching TFT "$T_S$," the storage capacitor "$C_{ST}$" and the power line 130. A first electrode 140 of an organic electroluminescent (EL) diode "$D_{EL}$" is connected to the driving TFT "$T_D$" and a second electrode 150 of the organic EL diode "$D_{EL}$" may be grounded.

The switching TFT "$T_S$" adjusts a gate voltage of the driving TFT "$T_D$," and the storage capacitor "$C_{ST}$" stores charges corresponding to the gate voltage of the driving TFT "$T_D$." A pre-charge element "$T_{PRE}$" such as a transistor is connected to one end of the data line 120. A pre-charge signal "PRECH" is input to a gate electrode of the pre-charge element "$T_{PRE}$" and a black signal "$V_{BLACK}$" is applied to a drain electrode of the pre-charge element "$T_{PRE}$" from an exterior source. The black signal "$V_{BLACK}$" may correspond to a voltage for production of a black image. Accordingly, input of the black signal "$V_{BLACK}$" to the data line 120 is controlled by the pre-charge signal "PRECH." The pre-charge element "$T_{PRE}$" may be connected to each data line 120, and may be formed on the same substrate having the switching TFT "$T_S$" and the driving TFT "$T_D$." Even though not shown in FIG. 5, the pre-charge element "$T_{PRE}$" may be formed in an exterior circuit connected to an organic EL panel of the organic ELD device 100.

In particular, the black signal "$V_{BLACK}$" is applied to the gate electrode of the driving TFT "$T_D$" in a corresponding pixel region "P" during a predetermined time period, that is after input of the corresponding gate signal but before input of the corresponding data signal. Accordingly, a voltage of the gate electrode of the driving TFT "$T_D$" varies always from a low value to a high value while the organic ELD device operates. As a result, a hysteresis of the driving TFT "$T_D$" does not occur and an abnormal display such as a residual image is prevented. Although not shown, instead of applying the black signal "$V_{BLACK}$" to the gate electrode of the driving TFT "$T_D$" through the pre-charge element "$T_{PRE}$," other types of signal, e.g., a white signal corresponding to a voltage for production of a white image, may be applied to the gate electrode of the driving TFT "$T_D$" through the pre-charge element "$T_{PRE}$." Moreover, the black signal "$V_{BLACK}$" may correspond to a minimum value or a maximum value among voltages to be applied to the gate electrode of the driving TFT "$T_D$", e.g., a threshold voltage or a saturation voltage of the driving TFT "$T_D$."

Figure 6:
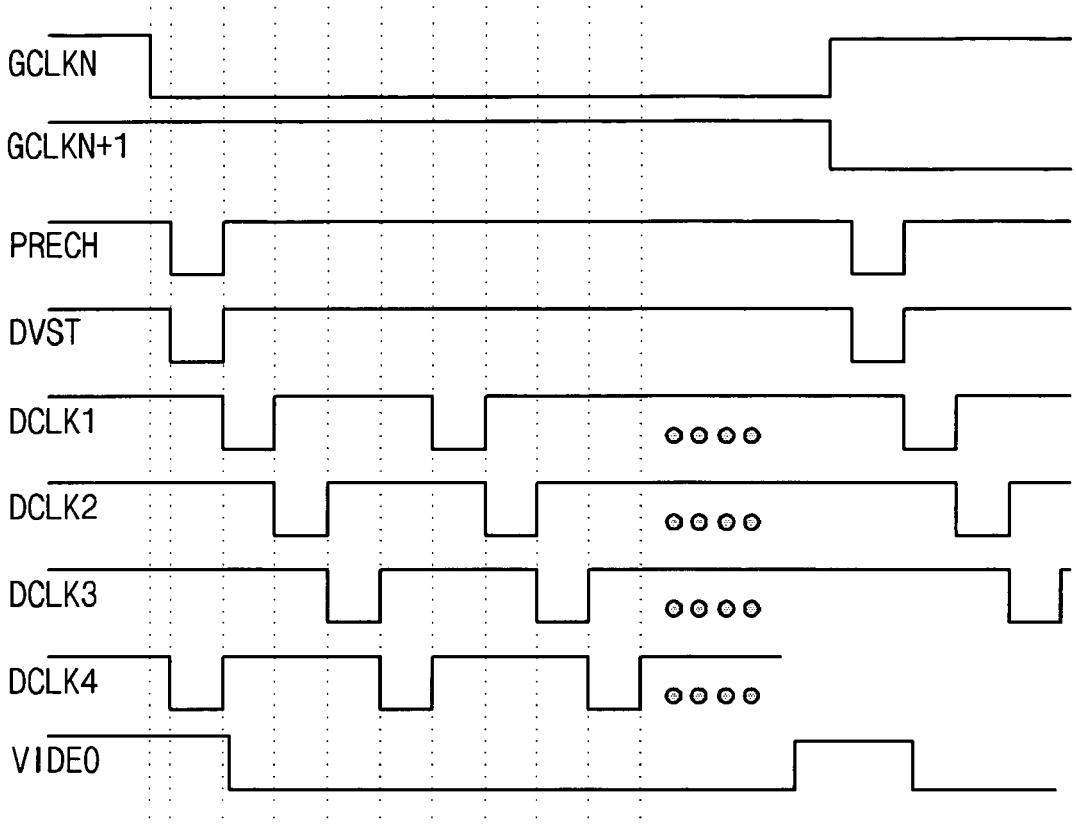
FIG. 6 is a schematic timing chart showing several signals used in an organic electroluminescent display device according to an embodiment of the present invention.

FIG. 6 is a schematic timing chart showing several signals used in an organic electroluminescent display device according to an embodiment of the present invention. In FIG. 6, gate scanning pulses are sequentially input to an $N^{th}$ gate line and an $(N+1)^{th}$ gate line according to an $N^{th}$ gate clock "GCLKN" and an $(N+1)^{th}$ gate clock "GCLKN+1." As a result, switching TFTs connected to the $N^{th}$ gate line and the $(N+1)^{th}$ gate line are sequentially turned on line-by-line.

While the gate scanning pulse is input to the $N^{th}$ gate line, a data start signal "DVST" synchronizes with a fourth data clock "DCLK4" and a data signal "VIDEO" is applied to a gate electrode of a driving TFT "$T_D$" (of FIG. 5) through a switching TFT "$T_S$" (of FIG. 5) in a pixel region according to a first data clock "DCLK1." As a result, a current corresponding to the data signal "VIDEO" flows through an organic EL diode "$D_{EL}$" (of FIG. 5) of the pixel region, and the organic EL diode "$D_{EL}$" (of FIG. 5) emits light.

Next, the data signal "VIDEO" is sequentially applied to the driving TFTs "$T_D$" (of FIG. 5) in next pixel regions according to a second data clock "DCLK2," a third data clock "DCLK3" and the fourth data clock "DCLK4." As a result, currents corresponding to the data signal "VIDEO" sequentially flow through organic EL diodes "$D_{EL}$" (of FIG. 5) in the next pixel regions, and the organic EL diodes "$D_{EL}$" (of FIG. 5) in the next pixel regions sequentially emit light corresponding to the data signal "VIDEO."

In addition, a pre-charge signal "PRECH" synchronizes with the data start signal "DVST" and the fourth data clock "DCLK4." A pre-charge element "$T_{PRE}$" (of FIG. 5) such as a transistor connected to one end of a data line 120 (of FIG. 5) applies a black signal "$V_{BLACK}$" (of FIG. 5) corresponding to a black image to the corresponding data line 120 (of FIG. 5) according to the pre-charge signal "PRECH." Thus, the black signal "$V_{BLACK}$" (of FIG. 5) is applied to the data line 120 (of FIG. 5) during a predetermined time period before input of the data signal "VIDEO" through the pre-charge element "$T_{PRE}$" (of FIG. 5).

As a result, instead of the data signal of the previous frame, the black signal "$V_{BLACK}$" applied to the data line 120 is input to the gate electrode of the driving TFT "$T_D$." Accordingly, immediately before the data signal of the present frame is input to the gate electrode of the driving TFT "$T_D$," the gate electrode of the driving TFT "$T_D$" may have a voltage corresponding to the black signal "$V_{BLACK}$" regardless of the data signal of the previous frame. Thus, the voltage of the gate electrode of the driving TFT "$T_D$" varies from a low value of the black signal "$V_{BLACK}$" to a high value of the data signal of the present frame. Since the voltage of the gate electrode of the driving TFT "$T_D$" varies always along an increasing direction, the data signal corresponds to a single value of the drain-source current of the driving TFT "$T_D$" even when the driving TFT "$T_D$" has a hysteresis. Hence, an abnormal display such as a residual image is prevented.

Figure 7:
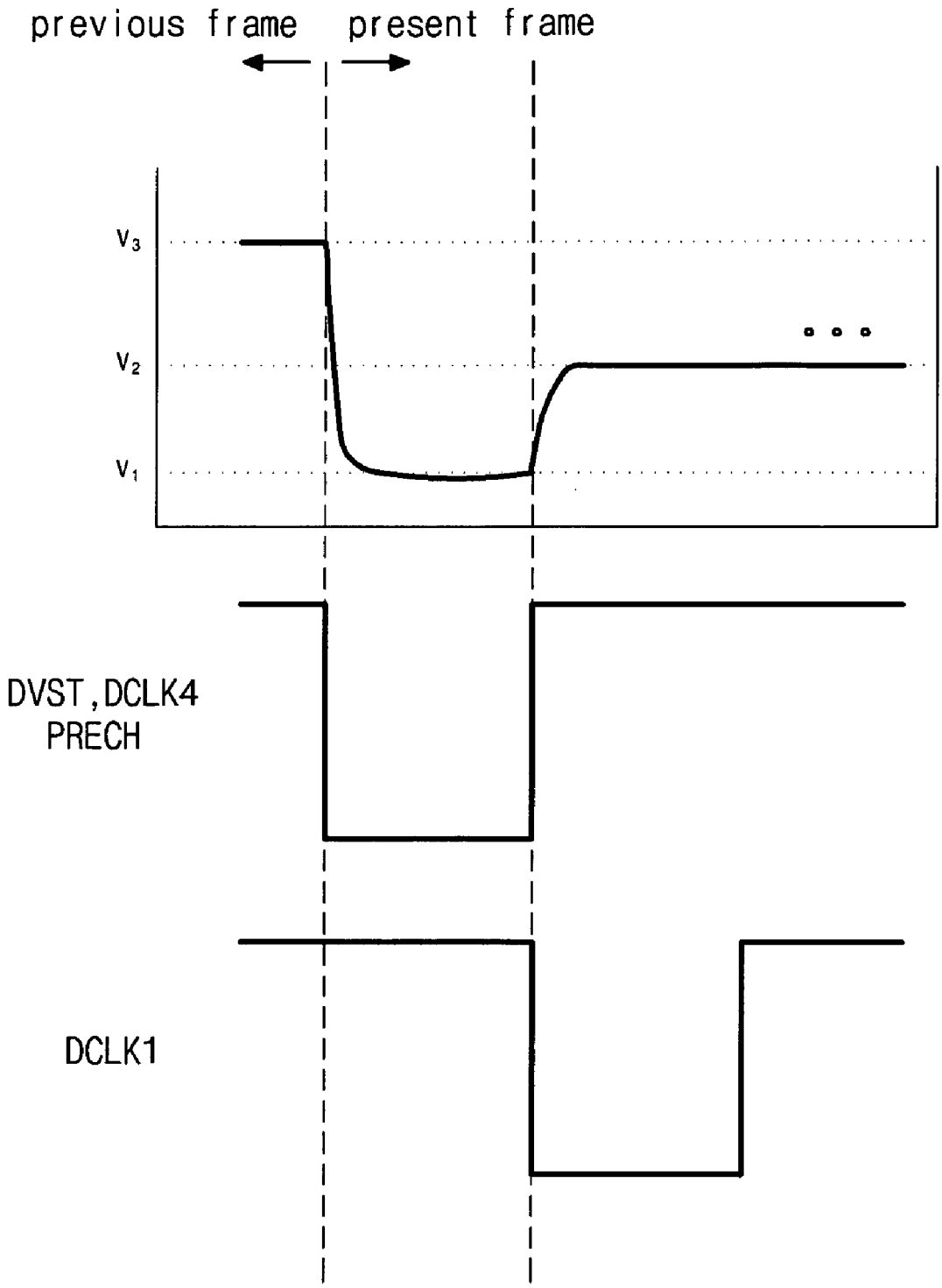
FIG. 7 is a graph showing a voltage variation of a gate electrode of a driving thin film transistor in an organic electroluminescent display device according to an embodiment of the present invention.

FIG. 7 is a graph showing a voltage variation of a gate electrode of a driving thin film transistor in an organic electroluminescent display device according to an embodiment of the present invention. In FIG. 7, for example, a pixel region of the organic ELD device may display a white image in a previous frame and may display a gray image in a present frame. In the previous frame, a third voltage "$V_3$," i.e., a data signal of the previous frame, corresponding to a white image is applied to a gate electrode of a driving TFT "$T_D$" (of FIG. 5) in the pixel region. In the present frame after the previous frame, a first voltage "$V_1$," i.e., a black signal "$V_{BLACK}$" (of FIG. 5), corresponding to a black image is input to the gate electrode of the driving TFT "$T_D$" (of FIG. 5) during a predetermined time period according to a pre-charge signal "PRECH" synchronizing with a data start signal "DVST" and a fourth data clock "DCLK4." Next, a second voltage "$V_2$," i.e., a data signal of the present frame, corresponding to a gray image is input to the gate electrode of the driving TFT "$T_D$" (of FIG. 5).

As a result, the voltage of the gate electrode of the driving TFT "$T_D$" (of FIG. 5) does not vary from the third voltage "$V_3$" directly to the second voltage "$V_2$." Instead, the voltage of the gate electrode of the driving TFT "$T_D$" (of FIG. 5) varies from the third voltage "$V_3$" to the second voltage "$V_2$" through the first voltage "$V_1$." Since the black signal corresponding to a black image is always input to the gate electrode of the driving TFT "$T_D$" (of FIG. 5) right before the data signal of the present frame is input, a gate voltage of the driving TFT "$T_D$" (of FIG. 5) varies always along a single increasing direction. As a result, a single data signal corresponds to a single drain-source current sweep, and an abnormal display such as a residual image is prevented even when the driving TFT "$T_D$" has a hysteresis.

Moreover, instead of a signal corresponding to a black image is input to a driving TFT immediately before a data signal of the present frame is input, a signal corresponding to a white image may be input to a driving TFT right before a data signal of the present frame is input.

Accordingly, the organic electroluminescent display device and the driving method thereof of an embodiment of the present invention employ a pre-charging element applying a constant signal to the driving TFT during a predetermined time period immediately before a data signal of the present frame is input. Thus, in the organic ELD device of an embodiment of the present invention, the driving TFT is driven to follow one single drain-source current sweep even when the driving TFT "$T_D$" has a hysteresis. As a result, an abnormal display such as residual image is prevented.

It will be apparent to those skilled in the art that various modifications and variations can be made in the organic electroluminescent display device and driving method thereof of the present invention without departing from the spirit or scope of the invention. Thus, it is intended that the present invention covers the modifications and variations of this invention provided they come within the scope of the appended claims and their equivalents.

What is claimed is:

1. An organic electroluminescent display device, comprising:

a gate line receiving a gate signal;

a data line crossing the gate line, the data line receiving a data signal;

a switching thin film transistor switching the data signal according to the gate signal;

a driving thin film transistor connected to the switching thin film transistor and receiving the data signal;

a power line supplying a current to the driving thin film transistor;

an organic electroluminescent diode connected to the driving thin film transistor; and a pre-charge element inputting a pre-charge voltage to the data line before the data line receives the data signal, the pre-charge voltage fixed to one of a first voltage corresponding to production of a black image and a second voltage corresponding to production of a white image.

2. The device according to claim 1, wherein the pre-charge element inputs the pre-charge voltage to the data line at about the same time as the gate signal is input to the gate line.

3. The device according to claim 1, wherein the organic electroluminescent diode emits light according to a quantity of the current passing through the driving thin film transistor.

4. The device according to claim 1, wherein the pre-charge element is connected one end of the data line.

5. The device according to claim 1, wherein the pre-charge element includes a transistor.

6. The device according to claim 1, wherein the pre-charge element, the switching thin film transistor and the driving thin film transistor are formed on the same substrate.

7. The device according to claim 1, wherein a gate electrode of the switching thin film transistor is connected to the gate line, a source electrode of the switching thin film transistor is connected to a gate electrode of the driving thin film transistor, a drain electrode of the switching thin film transistor is connected to the data line, the source electrode of the driving thin film transistor is connected to the power line, and the drain electrode of the driving thin film transistor is connected to the organic electroluminescent diode.

8. The device according to claim 6, wherein the pre-charge element includes a thin film transistor having a gate electrode receiving a pre-charge signal corresponding to a time period before the data line receiving the data signal, a source electrode connected to the data line, and a drain electrode receiving the pre-charge voltage.

9. The device according to claim 1, further comprising a storage capacitor connected to the driving thin film transistor and the power line.

10. A method of driving an organic electroluminescent display device, comprising: inputting a gate signal to a gate line; inputting a data signal to a data line; and setting a pre-charge voltage to be one of a first voltage and a second voltage, the first voltage corresponding to production of a black image by an organic electroluminescent diode connected to a driving thin film transistor and the second voltage corresponding to production of a white image by the organic electroluminescent diode; and inputting a pre-charge voltage to the data line before inputting the data signal to the data line wherein the pre-charge voltage is applied to a the driving thin film transistor through a switching thin film transistor connected to the gate line and the data line.

11. The method according to claim 10, wherein the pre-charge voltage is input to the data line at about the same time as the gate signal is input to the gate line.

12. The method according to claim 10, wherein the pre-charge voltage is input to the data line through a pre-charge element connected to one end of the data line.

* * * * *